United States Patent [19]

Hart et al.

[11] Patent Number: 5,059,579

[45] Date of Patent: Oct. 22, 1991

[54] RECEIVER SHEET

[75] Inventors: Charles H. Hart, Hutton Rudby; John Francis, Levendale; Roger Waldron, Guisborough, all of England

[73] Assignee: Imperial Chemical Industries PLC, London, England

[21] Appl. No.: 371,735

[22] Filed: Jun. 27, 1989

[30] Foreign Application Priority Data

Jun. 30, 1988 [GB] United Kingdom ..... 8815632

[51] Int. Cl.[5] ..... B41M 5/035; B41M 5/26

[52] U.S. Cl. ..... 503/227; 8/471; 428/195; 428/323; 428/330; 428/480; 428/910; 428/913; 428/914

[58] Field of Search ..... 8/471; 428/195, 913, 428/914, 323, 330, 480, 910; 503/227

[56] References Cited

U.S. PATENT DOCUMENTS 4,720,480 1/1988 Ito et al. ..... 503/227

FOREIGN PATENT DOCUMENTS 0194106 10/1986 European Pat. Off. ..... 503/227
62-282975 12/1987 Japan ..... 503/227
1487374 9/1977 United Kingdom ..... 503/227

*Primary Examiner*—Bruce H. Hess
*Attorney, Agent, or Firm*—Cushman, Darby & Cushman

[57] ABSTRACT

A thermal transfer printing (TTP) receiver sheet for use in association with a compatible donor sheet, comprises a supporting substrate having, on at least one surface thereof, (a) a dye-receptive receiving layer to receive a dye thermally transferred form the donor sheet, said receiver sheet additionally comprises, on at least one surface thereof, (b) an antistatic layer, said antistatic layer preferably being on a second surface of said substrate. The antistatic layer preferably comprises (a) a polychlorhydrin ether of an ethoxylated hydroxyamine and (b) a polyglycol amine, the total alkali metal consent of components (a) and (b) not exceeding 0.5% of the combined weight of (a) and (b).

14 Claims, 1 Drawing Sheet

RECEIVER SHEET

BACKGROUND OF THE INVENTION a) Technical Field of Invention

This invention relates to thermal transfer printing and, in particular, to a thermal transfer printing receiver sheet for use with an associated donor sheet.

b) Background of the Art

Currently available thermal transfer printing (TTP) techniques generally involve the generation of an image on a receiver sheet by thermal transfer of an imaging medium from an associated donor sheet. The donor sheet typically comprises a supporting substrate of paper, synthetic paper or a polymeric film material coated with a transfer layer comprising a sublimable dye incorporated in an ink medium usually comprising a wax and/or a polymeric resin binder. The associated receiver sheet usually comprises a supporting substrate, of a similar material, having on a surface thereof a dye-receptive, polymeric receiving layer. When an assembly, comprising a donor and a receiver sheet positioned with the respective transfer and receiving layers in contact, is selectively heated in a patterned area derived, for example—from an information signal, such as a television signal, dye is transferred from the donor sheet to the dye-receptive layer of the receiver sheet to form therein a monochrome image of the specified pattern. By repeating the process with different monochrome dyes, a full coloured image is produced on the receiver sheet.

To facilitate separation of the imaged sheet from the heated assembly, at least one of the transfer layer and receiving layer may be associated with a release medium, such as a silicone oil.

At the printing or transfer stage in a typical TTP operation both the transfer layer and the receiving layer are likely to be in a molten state, and there is a tendency for the donor sheet to become thermally bonded to the receiver sheet. Such bonding may induce wrinkling or even rupture of the donor sheet when separation thereof from the imaged receiver sheet is attempted. In certain circumstances, total transfer of the dye-containing transfer layer to the receiver sheet may occur, so that the donor sheet is effectively destroyed and portions thereof become firmly adhered to the processed receiver sheet. To avoid such undesirable behavior, the release medium is required to promote relative movement between the donor sheet and the receiver sheet to permit easy separation of one from the other. However, advancement of the donor sheet, relative to the print-head, in register with the receiver sheet usually depends upon frictional engagement between the donor sheet and the receiver sheet, the latter being mounted on a forwardly displaceable roll or platen. Inadequate bonding between the respective sheets tends to result in loss of registration, and the generation of a poorly defined image. The release medium must therefore also promote frictional bonding between the donor and receiver sheets, and is thus required to satisfy two apparently conflicting criteria.

The commerical success of a TTP system depends, inter alia, on the development of an image having adequate intensity, contrast and definition. Optical Density of the image is therefore an important criterion, but unfortunately, the presence of a release medium may inhibit migration of the dye into the receiving layer, thereby reducing the optical density of the resultant image. The problem of inadequate optical density is particularly acute if the release medium is modified in any way such that it constitutes a barrier to migration of dye from the donor to the receiver sheet—for example, when the release medium is substantially cross-linked. Likewise, inclusion in the release medium of extraneous materials likely further to inhibit dye migration is undesirable.

Although the intense, localised heating required to effect development of a sharp image may be applied by various techniques, including laser beam imaging, a convenient and widely employed technique of thermal printing involves a thermal print-head, for example, of the dot matrix variety in which each dot is represented by an independent heating element (electronically controlled, if desired). A problem associated with such a contact print-head is the deformation of the receiver sheet resulting from pressure of the respective elements on the heated, softened assembly. This deformation manifests itself as a reduction in the surface gloss of the receiver sheet, and is particularly significant in receiver sheets the surface of which is initially smooth and glossy, i.e. of the kind which is in demand in the production of high quality art-work. A further problem associated with pressure deformation is the phenomenon of "strike-through" in which an impression of the image is observed on the rear surface of the receiver sheet, i.e. the free surface of the substrate remote from the receiving layer.

c) The Prior Art

Various receiver sheets have been proposed for use in TTP processes. For example, EP-A-0133012 discloses a heat transferable sheet having a substrate and an image-receiving layer thereon, a dye-permeable releasing agent, such as silicone oil, being present either in the image-receiving layer or as a release layer on at least part of the image receiving layer. Materials identified for use in the substrate include condenser paper, glassine paper, parchment paper, or a flexible thin sheet of a paper or plastics film (including polyethylene terephthalate) having a high degree of sizing, although the exemplified substrate material is primarily a synthetic paper—believed to be based on a propylene polymer. The thickness of the substrate is ordinarily of the order of 3 to 50 μm. The image-receiving layer may be used on a resin having an ester, urethane, amide, urea, or highly polar linkage.

Related European patent application EP-A-0133011 discloses a heat transferable sheet based on similar substrate and imaging layer materials save that the exposed surface of the receptive layer comprises first and second regions respectively comprising (a) a synthetic resin having a glass transition temperature of from −100° to 20° C. and having a polar group, and (b) a synthetic resin having a glass transition temperature of 40° C. or above. The receptive layer may have a thickness of from 3 to 50 μm when used in conjunction with a substrate layer, or from 60 to 200 μm when used independently.

As hereinbefore described, problems associated with commercially available TTP receiver sheets include inadequate intensity and contrast of the developed image, reduction in gloss of the imaged sheet, strike-through of the image to the rear surface of the sheet, and difficulty in maintaining register during the printing cycle. In addition, difficulties have been experienced in smoothly feeding receiver sheets to a print-head.

We have now devised a receiver sheet for use in a TTP process which overcomes or substantially eliminates the aforementioned defects.

SUMMARY OF THE INVENTION

Accordingly, the present invention provides a thermal transfer printing receiver sheet for use in association with a compatible donor sheet, the receiver sheet comprising a supporting substrate having, on at least one surface thereof, a dye-receptive receiving layer to receive a dye thermally transferred from the donor sheet, the receiver sheet additionally comprises, on at least one surface thereof, (b) an antistatic layer, said antistatic layer preferably being on a second surface of said substrate.

The invention also provides a method of producing a thermal transfer printing receiver sheet for use in association with a compatible donor sheet, comprising forming a supporting substrate having, on at least one surface thereof, a dye-receptive receiving layer to receive a dye thermally transferred from the donor sheet, said receiver sheet additionally comprising, on at least one surface thereof, (b) an antistatic layer, said antistatic layer preferably being on a second surface of said substrate.

DETAILED DESCRIPTION AND PREFERRED EMBODIMENTS OF THE INVENTION

In the context of the invention the following terms are to be understood as having the meanings hereto assigned:

sheet: includes not only a single, individual sheet, but also a continuous web or ribbon-like structure capable of being sub-divided into a plurality of individual sheets.

compatible: in relation to a donor sheet, indicates that the donor sheet is impregnated with a dyestuff which is capable of migrating, under the influence of heat, into, and forming an image in, the receiving layer of a receiver sheet placed in contact therewith.

opaque: means that the substrate of the receiver sheet is substantially impermeable to visible light.

voided: indicates that the substrate of the receiver sheet comprises a cellular structure containing at least a proportion of discrete, closed cells.

film: is a self-supporting structure capable of independent existence in the absence of a supporting base.

antistatic: means that a receiver sheet treated by the application of an antistatic layer exhibits a reduced tendency, relative to an untreated sheet, to accumulate static electricity at the treated surface.

The substrate of a receiver sheet according to the invention may be formed from paper, but preferably from any synthetic, film-forming polymeric material. Suitable thermoplastics, synthetic, materials include a homopolymer or a copolymer of a 1-olefin, such as ethylene, propylene or butene-1, a polyamide, a polycarbonate, and particularly a synthetic linear polyester which may be obtained by condensing one or more dicarboxylic acids or their lower alkyl (up to 6 carbon atoms) diesters, e.g. terephthalic acid, isophthalic acid, phthalic acid, 2,5-, 2,6- or 2,7-naphthalenedicarboxylic acid, succinic acid, sebacic acid, adipic acid, azelaic acid, 4,4'-diphenyldicarboxylic acid, hexahydro-terephthalic acid or 1,2-bis-p-carboxyphenoxyethane (optionally with a monocarboxylic acid, such as pivalic acid) with one or more glycols, e.g. ethylene glycol, 1,3-propanediol, 1,4-butanediol, neopentyl glycol and 1,4-cyclohexanedimethanol. A polyethylene terephthalate film is particularly preferred, especially such a film which has been biaxially oriented by sequential stretching in two mutually perpendicular directions, typically at a temperature in the range 70° to 125° C., and preferably heat set, typically at a temperature in the range 150° to 250° C., for example—as described in British patent 838708.

A film substrate for a receiver sheet according to the invention may be uniaxially oriented, but is preferably biaxially oriented by drawing in two mutually perpendicular directions in the plane of the film to achieve a satisfactory combination of mechanical and physical properties. Formation of the film may be effected by any process known in the art for producing an oriented polymeric film—for example, a tubular or flat film process.

In a tubular process simultaneous biaxial orientation may be effected by extruding a thermoplastics polymeric tube which is subsequently quenched, reheated and then expanded by internal gas pressure to induce transverse orientation, and withdrawn at a rate which will induce longitudinal orientation.

In the preferred flat film process a film-forming polymer is extruded through a slot die and rapidly quenched upon a chilled casting drum to ensure that the polymer is quenched to the amorphous state.

Orientation is then effected by stretching the quenched extrudate in at least one direction at a temperature above the glass transition temperature of the polymer. Sequential orientation may be effected by stretching a flat, quenched extrudate firstly in one direction, usually the longitudinal direction, i.e. the forward direction through the film stretching machine, and then in the transverse direction. Forward stretching of the extrudate is conveniently effected over a set of rotating rolls or between two pairs of nip rolls, transverse stretching then being effected in a stenter apparatus. Stretching is effected to an extent determined by the nature of the film-forming polymer, for example—a polyester is usually stretched so that the dimension of the oriented polyester film is from 2.5 to 4.5 its original dimension in the, or each, direction of stretching.

A stretched film may be, and preferably is, dimensionally stabilised by heat-setting under dimensional restraint at a temperature above the glass transition temperature of the film-forming polymer but below the melting temperature thereof, to induce crystallisation of the polymer.

In a preferred embodiment of the invention, the receiver sheet comprises an opaque substrate. Opacity depends, inter alia, on the film thickness and filler content, but an opaque substrate film will preferably exhibit a Transmission Optical Density (Sakura Densitometer; type PDA 65; transmission mode) of from 0.75 to 1.75, and particularly of from 1.2 to 1.5.

A receiver sheet substrate is conveniently rendered opaque by incorporation into the film-forming synthetic polymer of an effective amount of an opacifying agent. However, in a further preferred embodiment of the invention the opaque substrate is voided, as hereinbefore defined. It is therefore preferred to incorporate into the polymer an effective amount of an agent which is capable of generating an opaque, voided substrate structure. Suitable voiding agents, which also confer opacity, include an incompatible resin filler, a particulate inorganic filler or a mixture of two or more such fillers.

By an "incompatible resin" is meant a resin which either does not melt, or which is substantially immiscible with the polymer, at the highest temperature encountered during extrusion and fabrication of the film. Such resins include polyamides and olefin polymers, particularly a homo- or co-polymer of a mono-alpha-olefin containing up to 6 carbon atoms in its molecule, for incorporation into polyester films, or polyesters of the kind hereinbefore described for incorporation into polyolefin films.

Particulate inorganic filler suitable for generating an opaque, voided substrate include conventional inorganic pigments and fillers, and particularly metal or metalloid oxides, such as alumina, silica and titania, and alkaline earth metal salts, such as the carbonates and sulphates of calcium and barium. Barium sulphate is a particularly preferred filler which also functions as a voiding agent.

Suitable fillers may be homogeneous and consist essentially of a single filler material or compound, such as titanium dioxide or barium sulphate alone. Alternatively, at least a proportion of the filler may be heterogeneous, the primary filler material being associated with an additional modifying component. For example, the primary filler particle may be treated with a surface modifier, such as a pigment, soap, surfactant, coupling agent or other modifier to promote or alter the degree to which the filler is compatible with the substrate polymer.

Production of a substrate having satisfactory degrees of opacity, voiding and whiteness requires that the filler should be finely-divided, and the average particle size thereof is desirably from 0.1 to 10 μm provided that the actual particle size of 99.9% by number of the particles does not exceed 30 μm. Preferably, the filler has an average particle size of from 0.1 to 1.0 μm, and particularly preferably from 0.2 to 0.75 μm. Decreasing the particle size improves the gloss of the substrate.

Particle sizes may be measured by electron microscope, coulter counter or sedimentation analysis and the average particle size may be determined by plotting a cumulative distribution curve representing the percentage of particles below chosen particle sizes.

It is preferred that none of the filler particles incorporated into the film support according to this invention should have an actual particle size exceeding 30 μm. Particles exceeding such a size may be removed by sieving processes which are known in the art. However, sieving operations are not always totally successful in eliminating all particles greater than a chosen size. In practice, therefore, the size of 99.9% by number of the particles should not exceed 30 μm. Most preferably the size of 99.9% of the particles should not exceed 20 μm.

Incorporation of the opacifying/voiding agent into the polymer substrate may be effected by conventional techniques—for example, by mixing with the monomeric reactants from which the polymer is derived, or by dry blending with the polymer in granular or chip form prior to formation of a film therefrom.

The amount of filler, particularly of barium sulphate, incorporated into the substrate polymer desirably should be not less than 5% nor exceed 50% by weight, based on the weight of the polymer. Particularly satisfactory levels of opacity and gloss are achieved when the concentration of filler is from about 8 to 30%, and especially from 15 to 20%, by weight, based on the weight of the substrate polymer.

Other additives, generally in relatively small quantities, may optionally be incorporated into the film substrate. For example, china clay may be incorporated in amounts of up to 25% to promote voiding, optical brighteners in amounts up to 1500 parts per million to promote whiteness, and dyestuffs in amounts of up to 10 parts per million to modify colour, the specified concentrations being by weight, based on the weight of the substrate polymer.

Thickness of the substrate may vary depending on the envisaged application of the receiver sheet but, in general, will not exceed 250 μm, and will preferably be in a range from 50 to 190 μm.

A receiver sheet having a substrate of the kind hereinbefore described offers numerous advantages including (1) a degree of whiteness and opacity essential in the production of prints having the intensity, contrast and feel of high quality art-work, (2) a degree of rigidity and stiffness contributing to improved resistance to surface deformation and image strike-through associated with contact with the print-head, and (3) a degree of stability, both thermal and chemical, conferring dimensional stability and curl-resistance.

When TTP is effected directly onto the surface of a voided substrate of the kind hereinbefore described, the optical density of the developed image tends to be low and the quality of the resultant print is generally inferior. A receiving layer is therefore required on at least one surface of the substrate, and desirably exhibits (1) a high receptivity to dye thermally transferred from a donor sheet, (2) resistance to surface deformation from contact with the thermal print-head to ensure the production of an acceptably glossy print, and (3) the ability to retain a stable image.

A receiving layer satisfying the aforementioned criteria comprises a dye-receptive, synthetic thermoplastics polymer. The morphology of the receiving layer may be varied depending on the required characteristics. For example, the receiving polymer may be of an essentially amorphous nature to enhance optical density of the transferred image, essentially crystalline to reduce surface deformation, or partially amorphous/crystalline to provide an appropriate balance of characteristics.

The thickness of the receiving layer may vary over a wide range but generally will not exceed 50 μm. The dry thickness of the receiving layer governs, inter alia, the optical density of the resultant image developed in a particular receiving polymer, and preferably is within a range of from 0.5 to 25 μm. In particular, it has been observed that by careful control of the receiving layer thickness to within a range of from 0.5 to 10 μm, in association with an opaque/voided polymer substrate layer of the kind herein described, a surprising and significant improvement in resistance to surface deformation is achieved, without significantly detracting from the optical density of the transferred image.

A dye-receptive polymer for use in the receiving layer, and offering adequate adhesion to the substrate layer, suitably comprises a polyester resin, particularly a copolyester resin derived from one or more dibasic aromatic carboxylic acids, such as terephthalic acid, isophthalic acid and hexahydroterephthalic acid, and one or more glycols, particularly an aliphatic glycol, such as ethylene glycol, diethylene glycol, triethylene glycol and neopentyl glycol. Typical copolyesters which provide satisfactory dye-receptivity and deformation resistance are those of ethylene terephthalate and ethylene isophthalate, espeically in the molar ratios of from 50 to 90 mole % ethylene terephthalate and correspondingly from 50 to 10 mole % ethylene isophthalate. Preferred copolyesters comprise from 65 to 85 mole % ethylene terephthalate and from 35 to 15 mole % ethylene isophthalate especially a copolyester of about 82 mole % ethylene terephthalate and about 18 mole % ethylene isophthalate.

Formation of a receiving layer on the substrate layer may be effected by conventional techniques—for example, by casting the polymer onto a preformed substrate layer. Conveniently, however, formation of a composite sheet (substrate and receiving layer) is effected by coextrusion, either by simultaneous coextrusion of the respective film-forming layers through independent orifices of a multi-orifice die, and thereafter uniting the still molten layers, or, preferably, by single-channel coextrusion in which molten streams of the respective polymers are first united within a channel leading to a die manifold, and thereafter extruded together from the die orifice under conditions of streamline flow without intermixing thereby to produce a composite sheet.

A coextruded sheet is stretched to effect molecular orientation of the substrate, and preferably heat-set, as hereinbefore described. Generally, the conditions applied for stretching the substrate layer will induce partial crystallisation of the receiving polymer and it is therefore preferred to heat set under dimensional restraint at a temperature selected to develop the desired morphology of the receiving layer. Thus, by effecting heat-setting at a temperature below the crystalline melting temperature of the receiving polymer and permitting or causing the composite to cool, the receiving polymer will remain essentially crystalline. However, by heat-setting at a temperature greater than the crystalline melting temperature of the receiving polymer, the latter will be rendered essentially amorphous. Heat-setting of a receiver sheet comprising a polyester substrate and a copolyester receiving layer is conveniently effected at a temperature within a range of from 175° to 200° C. to yield a substantially crystalline receiving layer, or from 200° to 250° C. to yield an essentially amorphous receiving layer.

The antistatic layer of a receiver sheet according to the invention preferably comprises (a) a polychlorohydrin ether of an ethoxylated hydroxyamine and (b) a polyglycol diamine, the total alkali metal content of components (a) and (b) not exceeding 0.5% of the combined weight of (a) and (b).

By an "alkali metal" is herein meant an element of Group I-A of the Periodic Table of the Elements displayed on page B3 of the Handbook of Chemistry and Physics, 46th edition, (The Chemical Rubber Company).

A polychlorohydrin ether of an ethoxylated hydroxyamine for use as component (a) of the antistatic layer is preferably a compound of the formula:

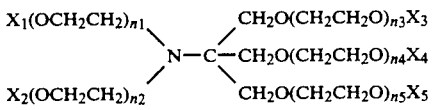

wherein each of $n_1$, $n_2$, $n_3$, $n_4$ and $n_5$ is an integer and the sum of $n_1$, $n_2$, $n_3$, $n_4$ and $n_5$ is from 5 to 100, preferably from 10 to 50, and each of $X_1$, $X_2$, $X_3$, $X_4$ and $X_5$ which may be the same or different, is —H or —$CH_2CH(OH)CH_2Cl$, with the proviso that at least one, and preferably two or more, of $X_1$, $X_2$, $X_3$, $X_4$ and $X_5$ is —$CH_2CH(OH)CH_2Cl$. Such a compound may be prepared by ethoxylating tris(hydroxymethyl) aminomethane followed by reaction with epichlorohydrin, as disclosed in British Patent GB1487374.

A polyglycol diamine for use as component (b) of the antistatic layer is preferably a compound of the formula:

$$H_2NCH_2CH(OH)CH_2[OCH_2CH_2]_{n6}OCH_2CH(OH)CH_2NH_2,$$

wherein $n_6$ is an integer of from 4 to 80 and preferably from 6 to 14. A compound of this kind is conveniently prepared by treating polyethylene glycol with epichlorohydrin followed by reaction with ammonia in the presence of a base, such as sodium hydroxide.

To avoid the development, after the antistatic coating has been dried, of an undesirable powdery surface bloom which not only impairs the optical clarity of the resultant sheet, but may also be wiped off during, and in a manner which interferes with, subsequent processing of the sheet, the alkali metal content of the antistatic medium should be maintained at the specified level.

Desirably, the alkali metal content of the antistatic medium should not exceed 0.5%, preferably 0.3%, and particularly preferably 0.16%, of the combined weight of components (a) and (b). These levels are conveniently achieved, for example—by dissolving the antistatic medium in a suitable solvent and removing a portion of the alkali metal content by filtration, followed by a deionising treatment in a suitable ion-exchange column.

Components (a) and (b), which are preferably present in the antistatic layer as hydrogen chloride salts, may be employed as a simple mixture or in the form of a water-soluble, partial condensate obtained, for example, by dissolving the components in water or an aqueous-organic medium and effecting partial condensation by stirring at a temperature of less than about 100° C., and preferably at ambient temperature, until the desired degree of condensation has been achieved. The partial condensation reaction may be terminated by diluting the reaction mixture with water, or preferably with an acid, such as hydrochloric acid, when the viscosity of the reaction mixture has increased to a level indicative of an acceptable degree of condensation. Either the mixture or the partial condensate is capable of being cross-linked, for example by heating, to improve durability of the antistatic layer.

The relative proportions of the respective components of the antistatic layer may vary within a wide range, and desirably should be selected by simple experimentation to provide an antistatic layer which confers upon the receiver sheet a Surface Resistivity not exceeding 12, and preferably less than 11.5 logohms/square at 50% Relative Humidity and 23° C. (measurement potential: 500 volts: 1EC93). Desirably, components (a) and (b) are present in a weight ratio of from about 0.5:1 to 5:1.

The antistatic layer(s) may be formed on the at least one receiving layer and/or on the substrate surface. Alternatively, the antistatic layer may be incorporated into the receiving layer.

The antistatic layer may be formed on a second surface (i.e. the surface remote from that to which the receiving layer is applied) of the substrate by conventional techniques—for example, it is preferred, particularly in the case of a polyester film substrate the formation of which involves relatively high extrusion and/or treatment temperatures, to deposit the antistatic layer directly onto at least one surface of a preformed film substrate from a solution or dispersion in a suitable volatile medium—preferably, for economy and ease of application, from an aqueous medium. In particular, it is preferred to apply the antistatic medium as an inter-draw coating between the two stages (longitudinal and transverse) of a biaxial film stretching operation.

The concentration of the antistatic components in the liquid coating medium depends, inter alia, on the level of antistatic properties required in the treated film, and on the wet thickness of the applied coating layer, but an effective amount conveniently comprises from about 0.5 to about 10%, preferably from 1 to 5% (weight-/volume).

If desired, the optical characteristics and processing behaviour of a receiver sheet according to the invention may be improved by incorporating therewith a minor amount of a modifier salt. Preferred modifier salts comprise a cation selected from the elements of Groups I-A, II-A, III-A and IV-B of the Periodic Table of the Elements, as hereinbefore defined. A modifier, if employed, is conveniently incorporated into the antistatic coating medium, and may be present in an amount such that the concentration of the cation is up to 0.3%, especially from about 0.05 to 0.25% by weight of components (a) and (b). Typical modifiers include salts such as the hydroxides and halides, especially chlorides, of sodium, calcium, aluminium and zirconium.

If desired, the coating medium may additionally comprise a minor amount, for example 0.5 to 4.0%, by weight of components (a) and (b), of a surfactant, such as an ethoxylated alkyl phenol, to assist wetting of the antistatic coating composition on the film surface.

If desired, and preferably, the coating medium incorporates a particulate material to improve the slip, anti-blocking and general handling characteristics of the sheet. The slip agent may comprise any particulate material which does not film-form during film processing subsequent to coating, for example—inorganic materials such as silica, china clay and calcium carbonate, and aqueous dispersions of organic polymers having a high glass transition temperature, for example—polymethyl methacrylate and polystyrene. The preferred slip agent is silica which is preferably employed as a colloidal sol containing particles of mean diameter 12–125 nm. The amount of slip additive is preferably in the range of from 10 to 40% of the dry weight of coating.

Preferably, the slip agent comprises a mixture of small particles of average diameter from 10 to 50 nm and large particles of average diameter from 70 to 150 nm. Conveniently, the weight ratio of small:large particles is from 2:1 to 4:1.

The antistatic coating medium may be applied to a substrate surface by conventional coating techniques. The applied coating medium is subsequently dried to remove the volatile medium and also to effect cross-linking of the antistatic components. Drying may be effected by conventional techniques—for example, by passing the coated film substrate through a hot air oven. Drying may, of course, be effected during normal post-formation film-treatments, such as heat-setting. The dried coating conveniently exhibits a dry coat weight of from about 0.1 to about 3.0, preferably from 0.2 to 1.0, mg/dm$^2$. The thickness of the antistatic layer is therefore generally within a range of from 0.01 to 0.3 μm, preferably 0.02 to 0.1 μm.

In a preferred embodiment of the invention a receiver sheet is rendered resistant to ultra violet (UV) radiation by incorporation of a UV stabiliser. Although the stabiliser may be present in any of the layers of the receiver sheet, it is preferably present in the receiving layer. The stabiliser may comprise an independent additive or, preferably, a copolymerised residue in the chain of the receiving polymer. In particular, when the receiving polymer is a polyester, the polymer chain conveniently comprises a copolymerised esterification residue of an aromatic carbonyl stabiliser. Suitably, such esterification residues comprise the residue of a di(hydroxyalkoxy)coumarin—as disclosed in European Patent Publication EP-A-31202, the residue of a 2-hydroxy-di(hydroxyalkoxy)benzophenone—as disclosed in EP-A-31203, the residue of a bis(hydroxyalkoxy)-xanth-9-one—as disclosed in EP-A-6686, and, particularly preferably, a residue of a hydroxy-bis(hydroxyalkoxy)-xanth-9-one—as disclosed in EP-A-76582. The alkoxy groups in the aforementioned stabilisers conveniently contain from 1 to 10 and preferably from 2 to 4 carbon atoms, for example—an ethoxy group. The content of esterification residue is conveniently from 0.01 to 30%, and preferably from 0.05 to 10%, by weight of the total receiving polymer. A particularly preferred residue is a residue of a 1-hydroxy-3, 6-bis(hydroxyalkoxy)xanth-9-one.

A receiver sheet in accordance with the invention may, if desired, comprise a release medium present either within the receiving layer or, preferably, as a discrete layer on at least part of the exposed surface of the receiving layer remote from the substrate.

The release medium, if employed, should be permeable to the dye transferred from the donor sheet, and comprises a release agent—for example, of the kind conventionally employed in TTP processes to enhance the release characteristics of a receiver sheet relative to a donor sheet. Suitable release agents include solid waxes, fluorinated polymers, silicone oils (preferably cured) such as epoxy- and/or amino-modified silicone oils, and especially organopolysiloxane resins. An organopolysiloxane resin is particularly suitable for application as a discrete layer on at least part of the exposed surface of the receiving layer.

The release medium may, if desired, additionally comprise a particulate adjuvant. Suitably, the adjuvant comprises an organic or an inorganic particulate material having an average particle size not exceeding 0.75 μm and being thermally stable at the temperatures encountered during the TTP operation. For example, during the transfer operation the receiving layer may encounter temperatures of up to about 290° C. for a period of the order of a few milliseconds (ms). Desirably, therefore, the adjuvant is thermally stable on exposure to a temperature of 290° C. for a period of up to 50 ms. Because of the brief exposure time to elevated temperatures the adjuvant may comprise a material having a nominal melting or softening temperature of less than 290° C. For example, the adjuvant may comprise a particulate organic material, especially a polymeric material such as a polyolefin, polyamide or an acrylic or methacrylic polymer. Polymethylmethacrylate (crystalline melting temperature: 160° C.) is suitable. Preferably, however, the adjuvant comprises an inorganic particulate material, especially a metal-or metalloid-oxide such as alumina, titania and silica.

The amount of adjuvant required in the release medium will vary depending on the required surface characteristics, and in general will be such that the weight ratio of adjuvant to release agent will be in a range of from 0.25:1 to 2.0:1. Higher adjuvant levels tend to detract from the optical characteristics of the receiver sheet and to inhibit penetration of dye through the release medium, while lower levels are usually inadequate to confer the desired surface frictional behaviour. Preferably, the weight ratio adjuvant: release agent is in a range of from 0.5:1 to 1.5:1, and especially from 0.75:1 to 1.25:1, for example 1:1.

To confer the desired control of surface frictional characteristics the average particle size of the adjuvant should not exceed 0.75 μm. Particles of greater average size also detract from the optical characteristics, such as haze, of the receiver sheet. Desirably, the average particle size of the adjuvant is from 0.001 to 0.5 μm, and preferably from 0.005 to 0.2 μm.

The required frictional characteristics of the release medium will depend, inter alia, on the nature of the compatible donor sheet employed in the TTP operation, but in general satisfactory behaviour has been observed with a receiver and associated release medium which confers a surface coefficient of static friction of from 0.075 to 0.75, and preferably from 0.1 to 0.5.

The release medium may be blended into the receiving layer in an amount up to about 50% by weight thereof, or applied to the exposed surface thereof in an appropriate solvent or dispersant and thereafter dried, for example—at temperatures of from 100° to 160° C., preferably from 100° to 120° C., to yield a cured release layer having a dry thickness of up to about 5 μm, preferably from 0.025 to 2.0 μm. Application of the release medium may be effected at any convenient stage in the production of the receiver sheet. Thus, if the substrate of the receiver sheet comprises a biaxially oriented polymeric film, application of a release medium to the surface of the receiving layer may be effected off-line to a post-drawn film, or as an in-line inter-draw coating applied between the forward and transverse film-drawing stages.

If desired, the release medium may additionally comprise a surfactant to promote spreading of the medium and to improve the permeability thereof to dye transferred from the donor sheet.

A release medium of the kind described yields a receiver sheet having excellent optical characteristics, devoid of surface blemishes and imperfections, which is permeable to a variety of dyes, and confers multiple, sequential release characteristics whereby a receiver sheet may be successively imaged with different monochrome dyes to yield a full coloured image. In particular, register of the donor and receiver sheets is readily maintained during the TTP operation without risk of wrinkling, rupture or other damage being sustained by the respective sheets.

BRIEF DESCRIPTION OF THE DRAWINGS

The invention is illustrated by reference to the accompanying drawings in which.

Figure 1:
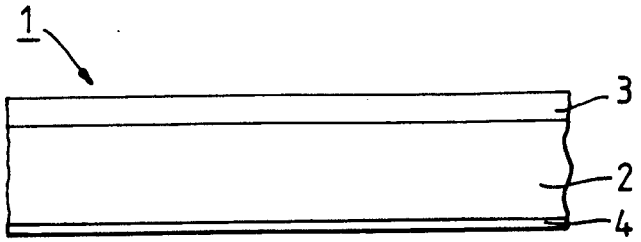
FIG. 1 is a schematic elevation (not to scale) of a portion of a TTP receiver sheet 1 comprising a polymeric supporting substrate 2 having, on a first surface thereof, a dye-receptive receiving layer 3 and, on a second surface thereof, an antistatic layer 4.
Figure 2:
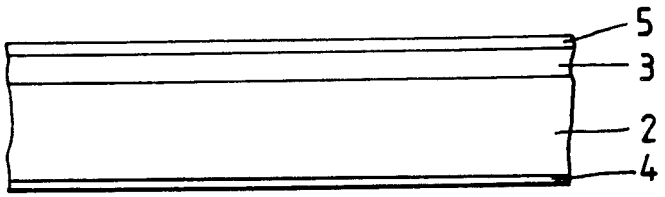
FIG. 2 is a similar, fragmentary schematic elevation in which the receiver sheet comprises an independent release layer 5.
Figure 3:
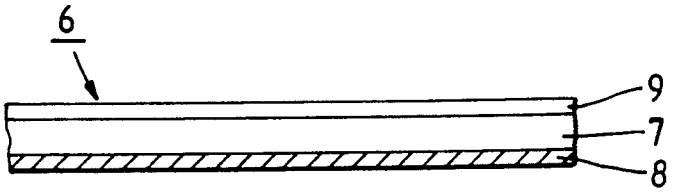
FIG. 3 is a schematic, fragmentary elevation (not to scale) of a compatible TTP donor sheet 6 comprising a polymeric substrate 7 having on one surface (the front surface) thereof a transfer layer 8 comprising a sublimable dye in a resin binder, and on a second surface (the rear surface) thereof a polymeric protective layer 9.
Figure 4:
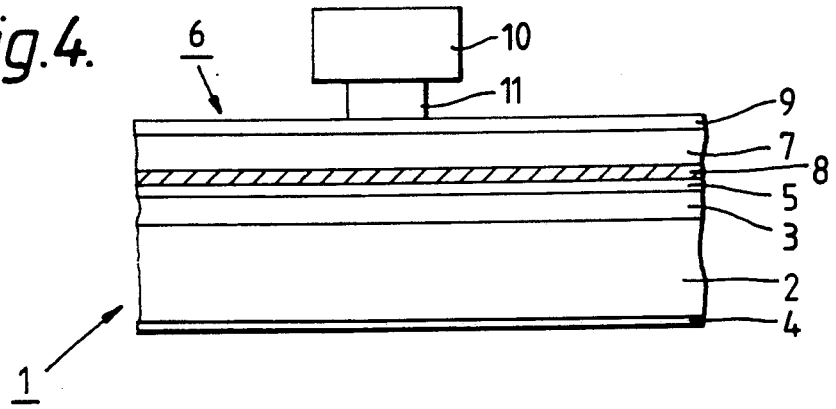
FIG. 4 is a schematic elevation of a TTP process.
Figure 5:
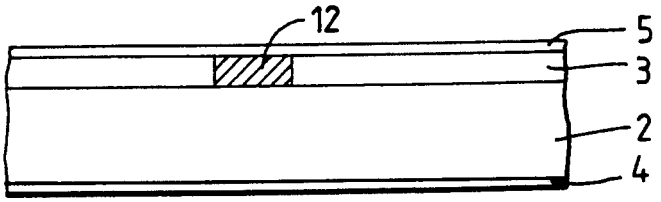
FIG. 5 is a schematic elevation of an imaged receiver sheet.

Referring to the drawings, and in particular to FIG. 4, a TTP process is effected by assembling a donor sheet and a receiver sheet with the respective transfer layer 8 and release 5 in contact. An electrically-activated thermal print-head 10 comprising a plurality of print elements 11 (only one of which is shown) is then placed in contact with the protective layer of the donor sheet. Energisation of the print-head causes selected individual print-elements 11 to become hot, thereby causing dye from the underlying region of the transfer layer to sublime through dye-permeable release layer 5 and into receiving layer 3 where it forms an image 12 of the heated element(s). The resultant imaged receiver sheet, separated from the donor sheet, is illustrated in FIG. 5 of the drawings.

By advancing the donor sheet relative to the receiver sheet, and repeating the process, a multi-colour image of the desired form may be generated in the receiving layer.

The invention is further illustrated by reference to the following Examples, wherein the material identified as "ELFUGIN PF" (supplied by Sandoz Products Ltd), by analysis contains a mixture in ethylene glycol of a compound of type (a) with $n_1+n_2+n_3+n_4+n_5$=ca. 13 and having 35 to 50% of $X_1+X_2+X_3+X_4+X_5$ as $—CH_2CH(OH)CH_2Cl$ (molecular weight ca. 800), together with oligomers of molecular weights 1600–6500, and compounds of type (b) with $n_6$ ranging from 6 to 14. The total amount of active organic matter is about 50% by weight.

EXAMPLE 1

To prepare a receiver sheet, separate streams of a first polymer comprising polyethylene terephthalate containing 18% by weight, based on the weight of the polymer, of a finely-divided particulate barium sulphate filler having an average particle size of 0.5 μm and a second polymer comprising an unfilled copolyester of 82 mole % ethylene terephthalate and 18 mole % ethylene isophthalate were supplied from separate extruders to a single-channel coextrusion assembly, and extruded through a film-forming die onto a water-cooled rotating, quenching drum to yield an amorphous cast composite extrudate. The cast extrudate was heated to a temperature of about 80° C. and then stretched longitudinally at a forward draw-ratio of 3.2:1.

The free surface of the filled polyester layer was then coated with an aqueous coating medium comprising:

| | |
|---|---|
| 'Elfugin' PF (50% w/w ethylene glycol solution; alkali metal content <0.2% w/w on solids, supplied by Sandoz Products Ltd) | 150 ml |
| 'Ludox' TM (50% w/w aqueous colloidal silica of mean particle size 22 nm, supplied by DuPont) | 24 ml |
| 'Syton' W30 (30% w/w aqueous colloidal silica of mean particle size 125 nm, supplied by Monsanto) | 15.5 ml |

-continued

| | |
|---|---|
| 'Synperonic' N (25% w/w aqueous solution of an ethoxylated nonyl phenol, supplied by ICI) | 10 ml |
| Demineralized water | to 2500 ml |

the pH of the mixture being adjusted to 9.0 with aqueous ammonia.

The coated, longitudinally stretched film was then heated to a temperature of about 96° C. and stretched transversely in a stenter oven at a draw ratio of 3.4:1. The stretched film was finally heat-set under dimensional restraint in a stenter oven at a temperature of about 225° C.

The resultant sheet comprised an opaque, voided primary substrate layer of filled polyethylene terephthalate of about 150 μm thickness having on one surface thereof a receiving layer of the isophthalate-terephthalate copolymer of about 4 μm thickness, and, on the second surface, an antistatic layer of about 35 nm thickness. By virtue of the heat-setting temperature employed, the receiving layer was of an essentially amorphous nature.

The antistatic layer of the receiver sheet had a surface resistivity of about 11.5 logohms/square at 50% relative humidity and 23° C. (IEC 93: measuring potential: 500 volts). Printer feedability was excellent, individual sheets being easily fed sequentially from a stack, without disruption, to the print head of a thermal transfer printer.

EXAMPLE 2

The procedure of Example 1 was repeated save that the concentration of each component in the coating medium was doubled.

The antistatic layer on the resultant sheet was of 70 nm thickness, and had a surface resistivity of about 11.3 logohms/square (IEC 93).

Printer feedability was again excellent.

EXAMPLE 3

This is a comparative example not according to the invention.

The procedure of Example 1 was repeated except that no antistatic layer was coated onto the free surface of the filled polyester layer. The uncoated polyester layer had a surface resistivity $>10^{16}$ logohms/square at 50% relative humidity and 23° C. (IEC 93: measuring potential: 500 volts). Printer feedability was poor, blocking occurring when attempts were made to feed sequentially a stack of sheets to the print head of a thermal transfer printer.

We claim:

1. A thermal transfer printing receiver sheet for use in association with a compatible donor sheet, the receiver sheet comprising a supporting substrate having, on at least one surface thereof, (1) a dye-receptive receiving layer to receive a dye thermally transferred from the donor sheet, characterised in that the receiver sheet additionally comprises, on at least one surface thereof, (2) an antistatic layer, wherein the antistatic layer comprises (a) a polychlorohydrin ether of an ethoxylated hydroxyamine and (b) a polyglycol diamine, the total alkali metal content of components (a) and (b) not exceeding 0.5% of the combined weight of (a) and (b).

2. A receiver sheet according to claim 1 wherein the antistatic layer is on a second surface of said substrate.

3. A receiver sheet according to claim 2 wherein component (a) of the antistatic layer comprises a compound of the formula:

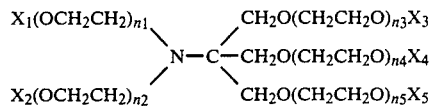

wherein each of $n_1$, $n_2$, $n_3$, $n_4$ and $n_5$ is an integer and the sum of $n_1$, $n_2$, $n_3$, $n_4$ and $n_5$ is from 5 to 100, and each of $X_1$, $X_2$, $X_3$, $X_4$ and $X_5$ which may be the same or different is —H or —$CH_2CH(OH)CH_2Cl$, with the proviso that at least one of $X_1$, $X_2$, $X_3$, $X_4$ and $X_5$ is —$CH_2CH(OH)CH_2Cl$.

4. A receiver sheet according to either of claims 2 or 3 wherein component (b) of the antistatic layer comprises a compound of the formula:

$$H_2NCH_2CH(OH)CH_2[OCH_2CH_2]_{n6}OCH_2CH(OH)CH_2NH_2,$$

wherein $n_6$ is an integer of from 4 to 80.

5. A receiver sheet according to claims 3 or 4 wherein components (a) and (b) are present in the antistatic layer in a weight ratio (a):(b) of from 0.5:1 to 5.0:1.

6. A receiver sheet according to claim 1 wherein the antistatic layer includes a particulate slip agent.

7. A receiver sheet according to claim 1 wherein the substrate contains an effective amount of a voiding agent comprising an incompatible resin filler or a particulate inorganic filler.

8. A receiver sheet according to claim 7 wherein the filler comprises barium sulphate.

9. A receiver sheet according to claim 1 wherein the substrate comprises an oriented thermoplastics polymeric film.

10. A receiver sheet according to claim 1 wherein the dye-receptive receiving layer comprises a copolyester.

11. A receiver sheet according to claim 1 comprising a release layer on at least part of the surface of the receiving layer remote from the substrate.

12. A receiver sheet according to claim 11 wherein the release layer comprises adjuvant particles of average size not exceeding 0.75 μm.

13. A method of producing a thermal transfer printing receiver sheet for use in association with a compatible donor sheet, comprising forming a supporting substrate having on at least one surface thereof, (a) a dye-receptive receiving layer to receive a dye thermally transferred from the donor sheet, said receiver sheet additionally comprising, on at least one surface thereof, (b) an antistatic layer.

14. A method according to claim 13 wherein the antistatic layer comprises (a) a polychlorohydrin ether of an ethoxylated hydroxyamine and (b) a polyglycol diamine, the total alkali metal content of components (a) and (b) not exceeding 0.5% of the combined weight of (a) and (b).

* * * * *